US010385429B2

(12) United States Patent
Inoue et al.

(10) Patent No.: US 10,385,429 B2
(45) Date of Patent: Aug. 20, 2019

(54) HOT-ROLLED FERRITIC STAINLESS-STEEL PLATE, PROCESS FOR PRODUCING SAME, AND STEEL STRIP

(71) Applicant: NIPPON STEEL & SUMIKIN STAINLESS STEEL CORPORATION, Tokyo (JP)

(72) Inventors: Yoshiharu Inoue, Tokyo (JP); Norihiro Kanno, Tokyo (JP); Koji Ito, Tokyo (JP); Takeshi Tomura, Tokyo (JP); Koichi Iuchi, Tokyo (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 511 days.

(21) Appl. No.: 14/780,468

(22) PCT Filed: Mar. 27, 2014

(86) PCT No.: PCT/JP2014/059011
§ 371 (c)(1),
(2) Date: Sep. 25, 2015

(87) PCT Pub. No.: WO2014/157576
PCT Pub. Date: Oct. 2, 2014

(65) Prior Publication Data

US 2016/0053353 A1 Feb. 25, 2016

(30) Foreign Application Priority Data

Mar. 27, 2013 (JP) ..... 2013-066354

(51) Int. Cl.

| | |
|---|---|
| ***C22C 38/54*** | (2006.01) |
| ***C22C 38/00*** | (2006.01) |
| ***C21D 6/02*** | (2006.01) |
| ***C21D 8/04*** | (2006.01) |
| ***C21D 6/00*** | (2006.01) |
| ***C21D 8/02*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C22C 38/54* (2013.01); *C21D 6/004* (2013.01); *C21D 6/005* (2013.01); *C21D 6/008* (2013.01); *C21D 6/02* (2013.01); *C21D 8/0263* (2013.01); *C21D 8/0426* (2013.01); *C21D 8/0463* (2013.01); *C21D 9/46* (2013.01); *C22C 38/00* (2013.01); *C22C 38/001* (2013.01); *C22C 38/004* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 8/02* (2013.01); *C21D 2211/005* (2013.01)

(58) Field of Classification Search

CPC ..... C22C 38/46; C22C 38/44; C22C 38/42; C22C 38/06; C22C 38/04; C22C 38/02; C22C 38/54; C22C 38/50; C22C 38/48; C21D 8/0263; C21D 9/46; C21D 6/004; C21D 6/005

See application file for complete search history.

(56) References Cited

U.S. PATENT DOCUMENTS

| | | | |
|---|---|---|---|
| 5,626,694 | A | 5/1997 | Kawabata et al. |
| 6,426,039 | B2 | 7/2002 | Hirasawa et al. |
| 9,243,306 | B2 | 1/2016 | Kanno et al. |
| 2001/0003293 | A1 | 6/2001 | Hirata et al. |
| 2002/0144756 | A1 | 10/2002 | Hirata et al. |
| 2004/0170518 | A1 | 9/2004 | Oku et al. |
| 2005/0161133 | A1 | 7/2005 | Hamada et al. |
| 2005/0173033 | A1 | 8/2005 | Yazawa et al. |
| 2008/0138233 | A1 | 6/2008 | Tomita et al. |
| 2008/0199638 | A1 | 8/2008 | Lin et al. |
| 2009/0000703 | A1 | 1/2009 | Hamada et al. |
| 2009/0092513 | A1 | 4/2009 | Hamada et al. |
| 2009/0120536 | A1 | 5/2009 | Tomita et al. |
| 2009/0136378 | A1 | 5/2009 | Satou et al. |

(Continued)

FOREIGN PATENT DOCUMENTS

| | | | |
|---|---|---|---|
| CA | 2697138 | A1 | 2/2009 |
| CA | 2707518 | A1 | 7/2009 |

(Continued)

OTHER PUBLICATIONS

English Abstract and English Machine Translation of Tomimura et al. (JP 2003-160846) (Jun. 6, 2003).*

Chinese Office Action and Search Report for Chinese Application No. 201380006138.6, dated Jul. 27, 2015, including an English translation.

Chinese Office Action and Search Report for Chinese Application No. 201380008761.5, dated Aug. 5, 2015, including an English translation of the Search Report.

International Search Report and Written Opinion of the International Searching Authority (Forms PCT/ISA/210 and PCT/ISA/237) for International Application No. PCT/JP2014/055753, dated Apr. 22, 2014, including an English translation.

(Continued)

*Primary Examiner* — Jessee R Roe

(74) *Attorney, Agent, or Firm* — Birch, Stewart, Kolasch & Birch, LLP

(57) ABSTRACT

Ferritic stainless steel hot rolled sheet and steel strip excellent in toughness and corrosion resistance which have a predetermined chemical composition, have a Charpy impact value at 0° C. of 10 J/cm$^2$ or more, and have a thickness of 5.0 to 9.0 mm.

9 Claims, No Drawings

(56) References Cited

U.S. PATENT DOCUMENTS

| | | | | |
|---|---|---|---|---|
| 2010/0050617 | A1 | 3/2010 | Oku et al. | |
| 2010/0108200 | A1 | 5/2010 | Futamura et al. | |
| 2010/0272594 | A1 | 10/2010 | Hiraide | |
| 2011/0061777 | A1 | 3/2011 | Ishii et al. | |
| 2011/0110812 | A1 | 5/2011 | Hiraide et al. | |
| 2011/0123387 | A1* | 5/2011 | Kato | C22C 38/001 420/40 |
| 2011/0176954 | A1 | 7/2011 | Oku et al. | |
| 2012/0014830 | A1 | 1/2012 | Hamada et al. | |
| 2012/0020827 | A1 | 1/2012 | Nakamura et al. | |
| 2013/0004360 | A1 | 1/2013 | Kanno et al. | |
| 2013/0004361 | A1* | 1/2013 | Sakamoto | C22C 38/001 420/61 |
| 2013/0017116 | A1 | 1/2013 | Hatano et al. | |
| 2013/0129560 | A1 | 5/2013 | Matsuhashi et al. | |
| 2014/0023550 | A1 | 1/2014 | Hamada et al. | |
| 2015/0044085 | A1 | 2/2015 | Kanno et al. | |

FOREIGN PATENT DOCUMENTS

| | | | | |
|---|---|---|---|---|
| CN | 1380150 | A | 11/2002 | |
| CN | 1550565 | A | 12/2004 | |
| CN | 1788102 | A | 6/2006 | |
| CN | 101435054 | A | 5/2009 | |
| CN | 101454471 | A | 6/2009 | |
| CN | 101538683 | A | 9/2009 | |
| CN | 101784686 | A | 7/2010 | |
| CN | 101845603 | A | 9/2010 | |
| CN | 102131946 | A | 7/2011 | |
| CN | 102361999 | A | 2/2012 | |
| EP | 0478790 | A1 | 4/1992 | |
| EP | 0683241 | A2 | 11/1995 | |
| EP | 1249513 | A1 | 10/2002 | |
| EP | 1477574 | A2 | 11/2004 | |
| EP | 1930461 | A1 | 6/2008 | |
| EP | 2112245 | A1 | 10/2009 | |
| EP | 2351868 | A1 | 8/2011 | |
| JP | 59-159974 | A | 9/1984 | |
| JP | 63-162818 | A | 7/1988 | |
| JP | 3-274245 | A | 12/1991 | |
| JP | 4-218623 | A | 8/1992 | |
| JP | 5-33104 | A | 2/1993 | |
| JP | 5-70897 | A | 3/1993 | |
| JP | 5-320764 | A | 12/1993 | |
| JP | 7-41854 | A | 2/1995 | |
| JP | 8-41600 | A | 2/1996 | |
| JP | 8-60303 | A | 3/1996 | |
| JP | 8-74079 | A | 3/1996 | |
| JP | 8-199235 | A | 8/1996 | |
| JP | 8-199237 | A | 8/1996 | |
| JP | 9-263900 | A | 10/1997 | |
| JP | 9-279312 | A | 10/1997 | |
| JP | 2696584 | B2 | 1/1998 | |
| JP | 10-237602 | A | 9/1998 | |
| JP | 2896077 | B2 | 5/1999 | |
| JP | 2000-178693 | A | 6/2000 | |
| JP | 3067577 | B2 | 7/2000 | |
| JP | 2001-26826 | A | 1/2001 | |
| JP | 2001-181798 | A | 7/2001 | |
| JP | 3242007 | B2 | 12/2001 | |
| JP | 2002-30346 | A | 1/2002 | |
| JP | 2002-275596 | A | 9/2002 | |
| JP | 2003-155543 | A | 5/2003 | |
| JP | 2003-160846 | * | 6/2003 | C22C 38/54 |
| JP | 2004-218013 | A | 8/2004 | |
| JP | 2004-232074 | A | 8/2004 | |
| JP | 2004-270026 | A | 9/2004 | |
| JP | 2005-171377 | A | 6/2005 | |
| JP | 2006-37176 | A | 2/2006 | |
| JP | 2006-117985 | A | 5/2006 | |
| JP | 2006-233278 | A | 9/2006 | |
| JP | 2006-328525 | A | 12/2006 | |
| JP | 3926492 | B2 | 6/2007 | |
| JP | 2008-138270 | A | 6/2008 | |
| JP | 2008-144199 | A | 6/2008 | |
| JP | 2008-189974 | A | 8/2008 | |
| JP | 2008-190003 | A | 8/2008 | |
| JP | 2008-197631 | A | 8/2008 | |
| JP | 2008-248329 | A | 10/2008 | |
| JP | 2008-291282 | A | 12/2008 | |
| JP | 2008-297631 | A | 12/2008 | |
| JP | 2009-1834 | A | 1/2009 | |
| JP | 2009-68113 | A | 4/2009 | |
| JP | 2009-102728 | A | 5/2009 | |
| JP | 2009-120893 | A | 6/2009 | |
| JP | 2009-120894 | A | 6/2009 | |
| JP | 2009-167443 | A | 7/2009 | |
| JP | 2009-174040 | A | 8/2009 | |
| JP | 2009-174046 | A | 8/2009 | |
| JP | 2009-197306 | A | 9/2009 | |
| JP | 2009-197307 | A | 9/2009 | |
| JP | 2009-215648 | A | 9/2009 | |
| JP | 2009-235555 | A | 10/2009 | |
| JP | 2010-100877 | A | 5/2010 | |
| JP | 2010-106323 | A | 5/2010 | |
| JP | 2010-121208 | A | 6/2010 | |
| JP | 2010-156039 | A | 7/2010 | |
| JP | 2011-68948 | A | 4/2011 | |
| JP | 4702493 | B1 | 6/2011 | |
| JP | 2011-140709 | A | 7/2011 | |
| JP | 2011-179114 | A | 9/2011 | |
| JP | 2011-179116 | A | 9/2011 | |
| JP | 2011-190468 | A | 9/2011 | |
| JP | 2011-190524 | A | 9/2011 | |
| JP | WO 2011122513 | * | 11/2011 | C22C 38/00 |
| JP | 2011-246813 | A | 12/2011 | |
| JP | 2012-117084 | A | 6/2012 | |
| JP | 2012-140687 | A | 7/2012 | |
| JP | 2012-140688 | A | 7/2012 | |
| JP | 2012-193435 | A | 10/2012 | |
| JP | 2012-207252 | A | 10/2012 | |
| JP | 2013-213279 | A | 10/2013 | |
| KR | 10-2001-0062057 | A | 7/2001 | |
| KR | 2002-0045322 | A | 6/2002 | |
| KR | 10-2011-0115619 | A | 10/2011 | |
| WO | WO 95/20683 | A1 | 8/1995 | |
| WO | WO 03/004714 | A1 | 1/2003 | |
| WO | WO 2004/053171 | A1 | 6/2004 | |
| WO | WO 2011/024568 | A1 | 3/2011 | |
| WO | WO 2011/096454 | A1 | 8/2011 | |
| WO | WO 2011/111871 | A1 | 9/2011 | |
| WO | WO 2011/122513 | A1 | 10/2011 | |
| WO | WO 2012/018074 | A1 | 2/2012 | |
| WO | WO 2012/108479 | A1 | 8/2012 | |
| WO | WO 2012/133573 | A1 | 10/2012 | |

OTHER PUBLICATIONS

International Search Report and Written Opinion of the International Searching Authority (Forms PCT/ISA/210 and PCT/ISA/237) for International Application No. PCT/JP2013/058856, dated Jun. 11, 2013, including an English translation.

International Search Report for International Application No. PCT/JP2013/053665, dated May 7, 2013, including an English translation.

International Search Report for International Application No. PCT/JP2013/056531, dated May 28, 2013.

Kato et al., "Development of a Ferritic Stainless Steel with Excellent Heat Resistance," Transactions of the Society of Automotive Engineers of Japan, vol. 39, No. 2, Mar. 25, 2008, pp. 329-333, including an English Abstract.

Canadian Office Action for Canadian Application No. 2,861,030, dated Nov. 25, 2015.

Canadian Office Action for Canadian Application No. 2,866,136, dated Feb. 12, 2016.

Chinese Office Action and Search Report for Chinese Application No. 201280046386.9, dated Jun. 1, 2015, including an English translation.

Chinese Office Action and Search Report for Chinese Application No. 201480006916.6, dated Apr. 1, 2016, including an English translation of the Search Report.

(56) References Cited

OTHER PUBLICATIONS

International Search Report for International Application No. PCT/JP2012/081693, dated Mar. 5, 2013, including an English translation.
Ito et al., "Development of Automatic Analyzer for Sulfuric Acid, Mixed Nitric Acid, and Hydrofluoric Acid in Stainless Pickling Process," Kagaku Kogaku Ronbunshu, vol. 25, No. 1, 1999, pp. 1-6, including an English Abstract.
Japanese Notice of Reasons for Rescission for Japanese Application No. 2013-548300, dated Oct. 31, 2016, with a partial English translation.
Japanese Office Action for Japanese Application No. 2013-027127, dated Jan. 12, 2016, with partial English translation.
Japanese Office Action for Japanese Application No. 2013-027127, dated Jul. 12, 2016, along with an English translation.
Japanese Opposition No. 2016-700654 for Japanese Application No. 2013-548300, dated Aug. 24, 2016, including partial English translation.
JFE Steel Corporation, Stainless Steel for Automobile Brochure, retrieved Dec. 31, 2015, pp. 1-23 (25 pages provided), including a partial English translation.
Korean Notice of Allowance for Korean Application No. 10-2015-7020744, dated Dec. 6, 2016, with an English translation.
Korean Notice of Preliminary Rejection for Korean Application No. 10-2014-7023338, dated Aug. 17, 2015, with a partial English translation.
Nisshin Steel Co., Ltd., Stainless Steel Brochure, retrieved Dec. 31, 2015, pp. 1-15 (16 pages provided), with partial English translation.
Partial English translation of Japanese Opposition No. 2016-700654 for Japanese Application No. 2013-548300, dated Aug. 24, 2016.
Portion of Japanese Patent No. 4167166 B2, dated Oct. 5, 2008, submitted by Third Party, including an English translation.
Third Party Observation Notification for International Application No. PCT/JP2012/081693, dated Nov. 22, 2013.
U.S. Office Action for U.S. Appl. No. 14/355,117, dated Feb. 9, 2016 (Final Rejection).
U.S. Office Action for U.S. Appl. No. 14/355,117, dated Mar. 27, 2017 (Non-Final Rejection).
U.S. Office Action for U.S. Appl. No. 14/355,117, dated Oct. 22, 2015 (Non-Final Rejection).
U.S. Office Action for U.S. Appl. No. 14/374,497, dated Aug. 8, 2016 (Non-Final Rejection).
U.S. Office Action for U.S. Appl. No. 14/374,497, dated Jan. 13, 2017 (Final Rejection).
U.S. Office Action for U.S. Appl. No. 14/383,434, dated Dec. 6, 2016 (Non-Final Rejection).
U.S. Office Action for U.S. Appl. No. 14/383,434, dated Jan. 7, 2016 (Non-Final Rejection).
U.S. Office Action for U.S. Appl. No. 14/383,434, dated Jun. 16, 2016 (Final Rejection).
U.S. Office Action for U.S. Appl. No. 14/383,434, dated Jun. 9, 2017 (Final Rejection).
U.S. Office Action for U.S. Appl. No. 14/383,434, dated Oct. 27, 2016 (Advisory Action).
U.S. Office Action for U.S. Appl. No. 14/384,121, dated Mar. 2, 2017 (Non-Final Rejection).
U.S. Office Action for U.S. Appl. No. 14/766,296, dated Jun. 15, 2017 (Final Rejection).
U.S. Office Action for U.S. Appl. No. 14/766,296, dated Mar. 20, 2017 (Non-Final Rejection).
U.S. Office Action for U.S. Appl. No. 14/969,310, dated Jun. 29, 2016 (Final Rejection).
U.S. Office Action for U.S. Appl. No. 14/969,310, dated Mar. 2, 2016 (Non-Final Rejection).
U.S. Notice of Allowance for U.S. Appl. No. 14/384,121, dated Aug. 2, 2017.
U.S. Notice of Allowance for U.S. Appl. No. 14/381,121, dated Nov. 16, 2017.
U.S. Office Action for U.S. Appl. No. 14/374,497, dated Aug. 21, 2017 (Non-Final Rejection).
U.S. Office Action for U.S. Appl. No. 14/383,434, dated Sep. 29, 2017 (Non-Final Rejection).
U.S. Office Action for U.S. Appl. No. 14/969,310, dated Dec. 1, 2017 (Final Rejection).
U.S. Office Action for U.S. Appl. No. 14/969,310, dated Dec. 6, 2016 (Non-Final Rejection).
U.S. Office Action for U.S. Appl. No. 14/969,310, dated Oct. 13, 2016 (Advisory Action).
U.S. Office Action, dated Dec. 11, 2017, for U.S. Appl. No. 15/726,722.
U.S. Office Action, dated Dec. 8, 2017, for U.S. Appl. No. 14/766,296.
U.S. Office Action, dated Oct. 11, 2017, for U.S. Appl. No. 14/355,117.
International Search Report, dated Jun. 3, 2014, for International Application No. PCT/JP2014/059011.
U.S. Office Action for U.S. Appl. No. 14/383,434, dated Oct. 9, 2015 (Restriction-Election Requirement).
U.S. Office Action for U.S. Appl. No. 14/969,310, dated Jun. 12, 2017 (Final Rejection).
Office Action dated Jun. 1, 2018 in U.S. Appl. No. 14/766,296.
U.S. Office Action for U.S. Appl. No. 14/383,434, dated Mar. 20, 2018.
U.S. Office Action dated Apr. 17, 2018 for U.S. Appl. No. 15/726,722.
U.S. Notice of Allowance for U.S. Appl. No. 14/374,497, dated Mar. 22, 2018.
U.S. Office Action, dated Aug. 2, 2018, for U.S. Appl. No. 14/383,434.
Advisory Action, dated Sep. 21, 2018, for U.S. Appl. No. 14/766,296.
Corrected Notice of Allowability, dated Jun. 14, 2018, for U.S. Appl. No. 14/374,497.
U.S. Office Action for U.S. Appl. No. 15/726,722, dated Oct. 19, 2018 (Non-Final Rejection).
Notice of Allowance, dated Oct. 11, 2018, for U.S. Appl. No. 14/969,310.
U.S. Office Action for U.S. Appl. No. 14/766,296, dated Jan. 28, 2019 (Non-Final Rejection).
Notice of Allowability for U.S. Appl. No. 14/969,310, dated Mar. 20, 2019.
U.S. Notice of Allowance for U.S. Appl. No. 14/766,296, dated Jun. 6, 2019.

* cited by examiner

HOT-ROLLED FERRITIC STAINLESS-STEEL PLATE, PROCESS FOR PRODUCING SAME, AND STEEL STRIP

TECHNICAL FIELD

The present invention relate to ferritic stainless steel hot rolled sheet which is excellent in toughness at low temperatures and is excellent in corrosion resistance and is used mainly for materials for flanges which are used at joints of piping in exhaust systems of automobiles etc. and a process for production and steel strip of the same.

BACKGROUND ART

Ferritic stainless steel is inferior compared with austenitic stainless steel in workability, toughness, and high temperature strength, but does not contain a large amount of Ni, so is inexpensive and, further, is small in heat expansion, so is used for materials for exhaust system parts of automobiles etc. In general, SUH409L, SUS429, SUS430LX, SUS436J1L, SUS432, SUS444, and other steel types are used as ferritic stainless steel suitable for these applications.

These materials are used shaped into pipes etc. Further, for the flange materials for connecting parts worked into these pipes etc. with each other (automobile flange materials), ordinary steel, even though inferior in corrosion resistance, is mainly being used. In recent years, the most inexpensive ferritic stainless steel SUH409L has also been used.

However, due to the need to lighten the automobile body weight and to extend service life etc., materials which are excellent in corrosion resistance are also being demanded for automobile flange materials. Ferritic stainless steel of SUH409L or more is being used. Further, in the case of use for exhaust systems, there is also the effect that the higher the strength at high temperatures, the thinner the sheet thickness can be designed, so ferritic stainless steel is advantageous over ordinary steel.

For use for automobile flange materials, in some cases, thickness 3 mm or less thin cold rolled steel sheet is used while improving the rigidity by bending etc., but in most cases thickness 5 mm or more thick hot rolled steel sheet is used as it is by just stamping.

However, thickness 5 mm or more hot rolled steel sheet of ferritic stainless steel is low in toughness, so is difficult to manufacture. In production of thickness 5 mm or more hot rolled steel sheet of ferritic stainless steel, the sheet often breaks on the production line after hot rolling. Therefore, up to now, studies on improving toughness have mainly started from the production aspect.

PLT 1 discloses a method comprising causing a finishing temperature at the time of hot rolling to change in accordance with the alloy composition, coiling, then rapidly cooling. Both PLT 2 and PLT 3 shows methods of improvement of toughness for the purpose of improving the manufacturability of thick gauge hot rolled coil.

When working ferritic stainless steel as an automobile flange material, in most cases stamping is used for production. Therefore, ferritic stainless steel which is inferior in toughness is disadvantageous. In particular, in stamping work in the winter, cracking often occurs and production of parts is difficult. Therefore, ferritic stainless steel sheet which is excellent in toughness and therefore free from hindering production of parts even in the winter has been desired.

CITATIONS LIST

Patent Literature

PLT 1: Japanese Patent Publication No. 64-56822A
PLT 2. Japanese Patent Publication No. 60-228616A
PLT 3. Japanese Patent Publication No. 2012-140688A

SUMMARY OF INVENTION

Technical Problem

In conventional ferritic stainless steel sheet, it was not necessarily possible to prevent cracking from occurring at the time of stamping at the time of production of flanges in the winter. The present invention has as its object the provision of ferritic stainless steel hot rolled sheet which is excellent in toughness and corrosion resistance and therefore usable for automobile flanges etc. and a process of production and steel strip of the same.

Solution to Problem

The inventors investigated the manufacturing environment of flange materials in the winter in their studies for improvement of toughness at low temperature. As a result, they learned that in the winter, stamping work is often performed in environments below room temperature (25° C.), but stamping work is almost never performed in environments below 0° C.

The ductile-brittle transition temperature of ferritic stainless steel is near room temperature. The toughness sometimes greatly changes due to temperature changes from room temperature to 0° C. Therefore, even in work where steel sheet will not crack in the summer, the steel sheet may crack in the winter. The inventors considered that it was not enough to study toughness only at room temperature (25° C.) and that if they could secure toughness at 0° C., cracking would not occur and therefore engaged in detailed studies with toughness at 0° C. as a parameter.

As a result, they learned that if the toughness value at 0° C. is 10 J/cm$^2$ or more, cracks will not occur at the time of stamping. To realize this, they learned that it is necessary to further limit the chemical components from the ranges of chemical components of the past—which were studied mainly from the viewpoint of manufacturing ability.

Hot rolled steel sheet is produced through the processes of melting, casting, hot rolling, annealing, and pickling, but studies of toughness up to now have mainly been concerned with the toughness of the material as hot rolled. In this regard, if comparing materials as hot rolled and materials annealed after hot rolling for toughness, materials annealed after hot rolling are lower in toughness. In the studies of the present invention, improvement of toughness in the more severe materials annealed after hot rolling had to be studied.

The inventors studied this and as a result obtained the findings that toughness at 0° C. can be secured by limiting the chemical components as follows.

(1) Reducing the Cr as much as possible.
(2) Reducing the Si.
(3) Not adding Ti or reducing it as much as possible.
(4) Adding a fine amount of Ni.
(5) Adding a fine amount of B.

Further, they discovered that No does not cause the toughness to fall that much and that a sufficient amount can be added when corrosion resistance and high temperature strength are required.

However, the inventors studied this and as a result learned that even if limiting the chemical components in this way, depending on the manufacturing conditions, the toughness of the hot rolled annealed sheet would not be stable. The inventors engaged in further study and as a result discovered that toughness at 0° C. can be stably secured by limiting the temperature of the final annealing and the cooling speed to certain constant ranges.

The present invention was reached based on these findings and has as its gist the following:

(1) A hot rolled ferritic stainless steel sheet comprising, by mass %, C: 0.015% or less, Si: 0.01 to 0.4%, Mn: 0.01 to 0.8%, P: 0.04% or less, S: 0.01% or less, Cr: 14.0 to less than 18.0%, Ni: 0.05 to 1%, Nb: 0.3 to 0.6%, Ti: 0.05% or less, N: 0.020% or less, Al: 0.10% or less, B: 0.0002 to 0.0020%, and a balance of Fe and unavoidable impurities, wherein the contents of Nb, C, and N satisfy Nb/(C+N)≥16, a Charpy impact value at 0° C. of the steep sheet is 10 J/cm$^2$ or more, and a thickness of the steel sheet is 5.0 to 9.0 mm.

(2) The hot rolled ferritic stainless steel sheet according to (1), further comprising, by mass %, one or more of Mo: 1.5% or less, Sn: 0.005 to 0.1%, Cu: 0.05 to 1.5%, V: 1% or less, and W: 1% or less.

(3) A method of production of the hoto rolled ferritic stainless steel sheet according to (1) or (2), comprising melting, casting, hot rolling, annealing, and pickling, wherein an annealing temperature in the annealing process is 1000° C. to 1100° C., and a cooling speed from 800° C. to 400° C. in a subsequent cooling process is 5° C./sec or more.

(4) A ferritic stainless steel strip comprised of the hot rolled ferritic stainless steel sheet according to (1) or (2).

(5) A ferritic stainless steel sheet for automobile flange use comprised of the hot rolled ferritic stainless steel sheet according to (1) or (2).

(6) A ferritic stainless steel sheet for automobile flange use comprised of the ferritic stainless steel strip according to (4).

DESCRIPTION OF EMBODIMENTS

Below, embodiments of the present invention will be explained. First, the reasons for limiting the steel composition of the stainless steel sheet of the present embodiments will be explained. Note that, in the compositions, the symbols "%" mean "mass %" unless otherwise indicated.

C: 0.015% or Less

C causes the shapeability and corrosion resistance and the toughness of the hot rolled sheet to deteriorate, so the smaller the content, the better. Further, in the present invention, Nb is added to stabilize C as carbonitrides, so from the viewpoint of reducing the amount of Nb as well, the smaller the amount of C, the better. Therefore, the upper limit of C is made 0.015%. However, excessive reduction causes an increase in the refining costs, so the lower limit is preferably made 0.001%. Further, if stressing the viewpoint of the corrosion resistance, 0.002 to 0.010% is preferable. More preferably, the content is 0.002 to less than 0.007%.

N: 0.020% or Less

N, like C, causes the shapeability and corrosion resistance and the toughness of the hot rolled sheet to deteriorate, so the smaller the content, the better. Further, in the present invention, Nb is added to stabilize N as carbonitrides, so from the viewpoint of reducing the amount of Nb as well, the smaller the amount of N, the better. Therefore, the upper limit of N is made 0.020%. However, excessive reduction leads to an increase in the refining costs, so the lower limit is preferably made 0.001%. Further, if stressing the corrosion resistance, 0.002 to 0.015% is preferable.

Si: 0.01 to 0.4%

Si is an element which is useful as a deoxidizing agent as well and an element which improves the high temperature strength and oxidation resistance. The deoxidizing effect is improved together with the increase in the amount of Si. The effect is manifested at 0.01% or more, so the lower limit of the amount of Si is made 0.01%. Excessive addition of Si causes the ordinary temperature ductility to fall. Further, Si also has the action of promoting precipitation of Laves phases and causing deterioration of toughness in the cooling process after annealing. Therefore, the upper limit of the amount of Si is made 0.4%. The more preferably content is 0.01 to 0.2%.

Mn: 0.01 to 0.8%

Mn is an element which is added as a deoxidizing agent and an element which contributes to the rise in high temperature strength in the medium temperature region. Mn does not affect the toughness much. To obtain the above effect, the amount of Mn has to be made 0.01% or more. On the other hand, excessive addition causes MnS to form and causes the corrosion resistance to fall, so the upper limit of the amount of Mn is made 0.8%. Preferably the content is 0.5% or less.

P: 0.04% or less

P is an element with a large solution strengthening ability, but is a ferrite stabilizing element and, further, is an element which is effective for the corrosion resistance and toughness, so is preferably as small as possible.

P is included as an impurity in the ferrochrome of the material of the stainless steel. Removing the P from the melt of the stainless steel is extremely difficult, so the content of P is preferably made 0.010% or more. The content of P is substantially determined by the purity and amount of the ferrochrome material which is used. P is a toxic element, so the concentration of the P in the ferrochrome material is preferably low, but low P ferrochrome is expensive, so the content of P is made a range not causing the material quality or corrosion resistance to greatly degrade, that is, 0.04% or less. Note that preferably the content is 0.03% or less.

S: 0.01% or Less

S forms sulfide-based inclusions and causes deterioration of the general corrosion resistance of steel materials (full surface corrosion or pitting), so the content is preferably small and is made 0.010%. Further, the smaller the content of S, the better the corrosion resistance, but lowering the S increases the desulfurization load and increases the manufacturing costs, so the lower limit is preferably 0.001%. Note that preferably the content is 0.001 to 0.008%.

Cr: 14.0 to Less than 18.0%

Cr is an element which is essential for securing corrosion resistance. However, Cr is also an element which causes a drop in toughness. If the content of Cr is less than 14.0%, the effect of securing corrosion resistance cannot be obtained, while if the content of Cr becomes 18.0% or more, in particular a drop in workability at low temperature or deterioration of toughness is caused, so the content of Cr is made 14.0 to less than 18.0%. To avoid 475° C. embrittlement in the cooling process after annealing, the smaller the amount of Cr the better. If considering the corrosion resistance more, 15.0 to less than 18.0% is preferable.

Ni: 0.05 to 1%

Ni is an element which is effective for suppressing advance of pitting. This effect is stably exhibited with 0.05% or more of addition. Along with this, this is effective for improvement of the toughness of hot rolled sheet. Therefore, the lower limit of the amount of N is made 0.05%. If made 0.10% or more, the effect becomes greater, while 0.15% or more is further effective. A large amount of addition is liable to invite hardening of the material due to solution strengthening, so the upper limit is made 1.0%. If considering the alloy cost, 0.05 to 0.30% is preferable.

Nb: 0.3 to 0.6%

Nb is an element which suppresses sensitization due to precipitation of chrome carbonitrides and the drop in corrosion resistance in stainless steel due to the formation of carbonitrides. If excessively adding Nb, the toughness falls due to formation of Laves phases. Considering these, the lower limit of Nb is made 0.3% and the upper limit is made 0.6%. Furthermore, from the corrosion resistance of the weld zone, Nb/(C+N) is made the substantially equivalent ratio of 16. To prevent sensitization of the weld zone better, it is preferable to make Nb/C+N 20 or more. In the formula, Nb, C, and N mean the respective amounts of the chemical components (mass %).

Ti: 0.05% or Less

Ti, like Nb, is an element which forms carbonitrides and suppresses sensitization and drop in corrosion resistance due to precipitation of chrome carbonitrides in stainless steel. However, the TiN which is formed is a large angular precipitate which easily forms the starting point of fracture and lowers the toughness. Further, Ti promotes the precipitation of Laves phases in the cooling process after annealing and causes deterioration of the toughness. Therefore, in the present invention, this has to be reduced as much as possible. The upper limit is made 0.05%. Preferably the content is made less than 0.02%.

Al: 0.10% or Less

Al is useful as a deoxidizing element. The effect is manifested at 0.005% or more. However, excessive addition of Al causes the ordinary temperature ductility and toughness to fall, so the upper limit is made 0.10%. Al need not be contained.

B: 0.0002 to 0.0020%

B is an element which is useful for immobilizing the N which is harmful to workability and for improving the secondary workability and promises improvement of toughness as well. The effect is manifested at 0.0002% or more, so the lower limit of the amount of B is made 0.0002%. Even if over 0.0020% is added, the effect is saturated and B causes deterioration of the workability, so the upper limit of B is made 0.0020%. Preferably the content is 0.0003% to less than 0.0008%.

Further, to improve the corrosion resistance, the following elements may be added.

Mo: 1.5% or Less

Mo may be added in accordance with need so as to improve the corrosion resistance. To manifest these effects, 0.01% or more is preferably added. More preferably, 0.10% or more, still more preferably 0.5% or more may be added. Excessive addition causes the formation of Laves phases and is liable to cause a drop in toughness. However, with steel which contains a large amount of Nb like in the present invention, the formation of Laves phases is also not accelerated that much and the toughness also does not fall. Considering these, the upper limit of the amount of Nb is made 1.5%. Preferably the content is 1.1% or less.

Sn: 0.005 to 0.1%

Sn is an element which is effective for improvement of the corrosion resistance and high temperature strength. Further, there is also the effect of not causing major deterioration of the mechanical properties at ordinary temperature. The effect on the corrosion resistance is manifested at 0.005% or more, so 0.005% or more is preferably added. More preferably 0.01% or more, still more preferably 0.03% or more may be added. If excessively added, the manufacturability and weldability remarkably deteriorate, so the upper limit of the amount of Sn is made 0.1%.

Further, the following elements may be added.

Cu: 0.05 to 1.5%

Cu is an element which improves the corrosion resistance. The effect is manifested at 0.05% or more. The more preferable amount of addition for obtaining the effect is 0.1% or more. Excessive addition also causes abnormal oxidation at the time of heating for hot rolling and becomes a cause of surface defects, so the upper limit of the amount of Cu is made 1.5%. Preferably, the content is 1.0% or less, more preferably 0.5% or less.

V: 1% or Less, W: 1% or Less

V and W are elements which cause improvement of the high temperature strength and can be added in accordance with need. To obtain the effect of improvement of the high temperature strength, 0.05% or more is preferably added. The more preferable content is 0.1% or more. Excessive addition causes the ordinary temperature ductility and toughness to fall, so the upper limit of the amount of addition is made 1%. Preferably the content is 0.5% or less.

The ferritic stainless steel of the present invention is hot rolled steel sheet and is formed into a finished product through the processes of melting, casting, hot rolling, annealing, and pickling. The manufacturing facilities are not particularly limited. Ordinary manufacturing facilities can be used. Usually stainless steel is extremely long in the rolling direction, that is, is produced in the form of steel strip, and is taken up and stored and moved in the form of a coil. In the present invention, not only ferritic stainless steel sheet, but also ferritic stainless steel strip is included.

The hot rolling conditions are not particularly prescribed, but the heating temperature is preferably 1150° C. to 1250° C. Further, hot rolling finishing temperature is preferably 850° C. or more. Furthermore, after hot rolling, mist cooling etc. is preferably used for rapid cooling down to 450° C.

What is important in the process of production of the present invention is the annealing process. The annealing temperature has to melt the Laves phases and other precipitates, so is made 1000° C. or more. However, if over 1100° C., the crystal grains grow too much and the toughness falls, so 1100° C. is made the upper limit.

The cooling speed after annealing suppresses the precipitation of Laves phases and other precipitates and drop of toughness due to 475° C. embrittlement, so the cooling speed from 800° C. to 400° C. is made 5° C./sec or more. Preferably, it is 10° C./sec or more. If 20° C./sec or more, the effect becomes saturated. Due to this, variations in toughness due to manufacture can be reduced. The metal structure does not appear to change in relation to 475° C. embrittlement, but it was confirmed that the Laves phases no longer precipitate or the amount of precipitation of Laves phases becomes a mass ratio of 1% or less.

According to the chemical composition of the present invention, a sufficient effect is manifested at the above cooling speed. There is no particular need for a cooling speed faster than the above (for example, 50° C./sec or more). In the present invention, in particular Cr, Si, and Ti can be used to suitably control the cooling speed after hot rolling and annealing. That is, it is possible to restrict the composition to a low Cr range of chemical components to avoid 475° C. embrittlement and further to lower the contents of Si and Ti to suppress the precipitation of Laves phases. Reduction of the Cr, Si, and Ti has in itself the effect of improving the toughness, so by limiting the range of chemical components and avoiding precipitation to control the structure, it becomes possible to easily produce thick gauge hot rolled coil with excellent toughness.

Due to these limits of chemical components and process of production, the toughness value by a Charpy test at 0° C. becomes 10 J/cm$^2$ or more and an excellent toughness is exhibited.

The sheet thickness is made 5.0 mm to 9.0 mm as the range of the present invention. If less than 5.0 mm, excellent toughness is realized without relying on the present invention If over 9.0 mm, even with the present invention, sufficient toughness cannot be realized and in addition manufacture also becomes difficult.

The ferritic stainless steel sheet and ferritic stainless steel strip of the present invention are excellent in corrosion resistance and further are excellent in toughness and resistant to cracking even if worked at 0° C., so can be particularly suitably used as ferritic stainless steel sheet and ferritic stainless steel strip for automobile flange use.

Below, examples will be used to explain the effects of the present invention. The present invention is not limited to the conditions used in the following examples.

EXAMPLES

Example 1

Steel of each of the compositions of chemical components which are shown in Table 1 was smelted and cast into a slab. The slab was heated to 1150 to 1250° C., then the finishing temperature was made 850 to 950° C. in range and the steel was hot rolled to a thickness of 6 mm to obtain hot rolled steel sheet. In Table 1, numerical values outside of the scope of the present invention are underlined. The hot rolled steel sheet was cooled by mist cooling down to 450° C., then was taken out in a coil.

After this, the hot rolled coil was annealed at 1000 to 1100° C. and was cooled down to ordinary temperature. At that time, the average cooling speed from 800 to 450° C. in range was made 10° C./s or more. Next, the hot rolled annealed sheet was pickled to obtain the finished product. In Table 1, Nos. 1 to 24 are invention examples, while Nos. 25 to 45 are comparative examples.

The thus obtained hot rolled annealed sheet was subjected to a Charpy impact test at 0° C. based on JIS Z 2242. The test piece in the present example was a sub-size test piece of the thickness of the hot rolled annealed sheet as is, so the Charpy energy was divided by the cross-sectional area (unit: cm$^2$) so as to compare and evaluate the toughnesses of the hot rolled annealed sheets of the different examples. Note that the evaluation criteria for toughness was the value of absorption energy at 0° C. 10 J/cm$^2$ or more was deemed as good and indicated as "G".

The stampability was evaluated by a stamping test at a temperature of 0° C. A press was used to stamp out 100 50ϕ disks and the numbers of cracks of the end faces were found. A number of cracks of five cracks or less was deemed passing.

Further, the surface of the annealed and pickled sheet was polished by #600 abrasive, then was subjected to a salt spray test by the method prescribed in JIS Z 2371 for 48 hours and checked for the presence of rusting. Samples with rust observed were judged as failing. The results of evaluation are shown in Table 1. In the table, passing was indicated by "G" (good) and failing by "P" (poor).

In addition, from the hot rolled sheets of the different steel types, the extraction residue method was used to obtain the precipitates which were then analyzed for compositions. From the amount of Nb of the results, the amount of precipitation of Laves phases was found assuming the entire amounts of C and N became Nb(C,N) and the remainder became the Laves phases. As a result, with the exception of Comparative Examples 20, 29, and 20 with large amounts of Si, Nb, and Ti, the mass ratios were all 1% or less.

TABLE 1

| | | Content of chemical components (mass %) | | | | | | | | | | |
|---|---|---|---|---|---|---|---|---|---|---|---|---|
| | No. | C | Si | Mn | P | S | Ni | Cr | N | Nb | Ti | Al |
| Inv. steel | 1 | 0.009 | 0.11 | 0.12 | 0.028 | 0.0005 | 0.18 | 14.3 | 0.014 | 0.38 | 0.005 | 0.03 |
| | 2 | 0.006 | 0.35 | 0.12 | 0.014 | 0.0006 | 0.09 | 14.7 | 0.012 | 0.42 | 0.01 | 0.07 |
| | 3 | 0.006 | 0.12 | 0.33 | 0.028 | 0.0006 | 0.12 | 17.2 | 0.012 | 0.38 | 0.005 | 0.05 |
| | 4 | 0.009 | 0.17 | 0.12 | 0.02 | 0.0008 | 0.8 | 17.8 | 0.014 | 0.51 | 0.005 | 0.04 |
| | 5 | 0.006 | 0.11 | 0.45 | 0.028 | 0.0006 | 0.17 | 15.2 | 0.012 | 0.38 | 0.005 | 0.03 |
| | 6 | 0.006 | 0.11 | 0.12 | 0.028 | 0.0006 | 0.12 | 17.2 | 0.012 | 0.42 | 0.005 | 0.03 |
| | 7 | 0.006 | 0.18 | 0.12 | 0.026 | 0.0008 | 0.08 | 14.2 | 0.012 | 0.38 | 0.005 | 0.03 |
| | 8 | 0.006 | 0.17 | 0.28 | 0.024 | 0.0012 | 0.3 | 17.2 | 0.009 | 0.38 | 0.004 | 0.03 |
| | 9 | 0.009 | 0.16 | 0.42 | 0.035 | 0.0013 | 0.12 | 14.6 | 0.012 | 0.38 | 0.005 | 0.03 |
| | 10 | 0.009 | 0.16 | 0.42 | 0.035 | 0.0013 | 0.12 | 14.6 | 0.012 | 0.38 | 0.005 | 0.03 |
| | 11 | 0.008 | 0.16 | 0.42 | 0.035 | 0.0013 | 0.12 | 14.6 | 0.012 | 0.42 | 0.005 | 0.03 |
| | 12 | 0.009 | 0.14 | 0.12 | 0.028 | 0.0006 | 0.18 | 17.2 | 0.013 | 0.38 | 0.005 | 0.03 |
| | 13 | 0.008 | 0.14 | 0.33 | 0.032 | 0.0021 | 0.16 | 16.3 | 0.012 | 0.38 | 0.007 | 0.03 |
| | 14 | 0.006 | 0.11 | 0.25 | 0.028 | 0.0006 | 0.12 | 17.2 | 0.008 | 0.38 | 0.005 | 0.04 |
| | 15 | 0.006 | 0.13 | 0.12 | 0.028 | 0.0018 | 0.15 | 17.8 | 0.012 | 0.38 | 0.005 | 0.03 |
| | 16 | 0.005 | 0.11 | 0.12 | 0.032 | 0.0006 | 0.12 | 17.2 | 0.012 | 0.35 | 0.006 | 0.04 |
| | 17 | 0.006 | 0.11 | 0.12 | 0.028 | 0.0006 | 0.15 | 17.2 | 0.012 | 0.38 | 0.005 | 0.03 |
| | 18 | 0.006 | 0.11 | 0.12 | 0.028 | 0.0006 | 0.12 | 17.2 | 0.012 | 0.38 | 0.005 | 0.03 |
| Comp. steel | 19 | 0.021 | 0.11 | 0.12 | 0.028 | 0.0005 | 0.18 | 14.3 | 0.014 | 0.58 | 0.005 | 0.03 |
| | 20 | 0.006 | 0.5 | 0.12 | 0.028 | 0.0005 | 0.18 | 14.3 | 0.014 | 0.32 | 0.004 | 0.03 |
| | 21 | 0.006 | 0.11 | 1.0 | 0.028 | 0.0005 | 0.18 | 14.6 | 0.014 | 0.33 | 0.005 | 0.03 |
| | 22 | 0.006 | 0.11 | 0.12 | 0.06 | 0.0005 | 0.18 | 14.2 | 0.014 | 0.41 | 0.005 | 0.02 |
| | 23 | 0.006 | 0.11 | 0.12 | 0.028 | 0.02 | 0.18 | 14.8 | 0.014 | 0.42 | 0.004 | 0.03 |
| | 24 | 0.006 | 0.11 | 0.12 | 0.028 | 0.0005 | 1.2 | 14.3 | 0.014 | 0.45 | 0.005 | 0.04 |
| | 25 | 0.006 | 0.11 | 0.12 | 0.028 | 0.0009 | 0.18 | 11.1 | 0.014 | 0.41 | 0.004 | 0.03 |
| | 26 | 0.006 | 0.15 | 0.12 | 0.028 | 0.0005 | 0.18 | 20.1 | 0.014 | 0.41 | 0.005 | 0.03 |
| | 27 | 0.006 | 0.16 | 0.12 | 0.028 | 0.0012 | 0.18 | 14.3 | 0.025 | 0.42 | 0.005 | 0.05 |
| | 28 | 0.006 | 0.18 | 0.12 | 0.028 | 0.0005 | 0.18 | 14.3 | 0.014 | 0.2 | 0.005 | 0.03 |

TABLE 1-continued

| | | | | | | | | | | | | |
|---|---|---|---|---|---|---|---|---|---|---|---|---|
| | 29 | 0.006 | 0.11 | 0.12 | 0.028 | 0.0009 | 0.18 | 14.3 | 0.014 | 0.7 | 0.005 | 0.03 |
| | 30 | 0.006 | 0.11 | 0.12 | 0.028 | 0.0005 | 0.18 | 14.3 | 0.014 | 0.42 | 0.1 | 0.03 |
| | 31 | 0.006 | 0.33 | 0.12 | 0.028 | 0.0008 | 0.18 | 14.3 | 0.009 | 0.42 | 0.005 | 0.15 |
| | 32 | 0.006 | 0.32 | 0.12 | 0.028 | 0.0007 | 0.18 | 14.3 | 0.014 | 0.43 | 0.005 | 0.03 |
| | 33 | 0.006 | 0.11 | 0.12 | 0.028 | 0.0006 | 0.18 | 14.3 | 0.008 | 0.43 | 0.005 | 0.03 |
| | 34 | 0.006 | 0.11 | 0.12 | 0.028 | 0.0005 | 0.18 | 14.3 | 0.014 | 0.43 | 0.005 | 0.03 |
| | 35 | 0.006 | 0.11 | 0.12 | 0.028 | 0.0008 | 0.18 | 14.3 | 0.015 | 0.43 | 0.005 | 0.03 |
| | 36 | 0.006 | 0.11 | 0.12 | 0.028 | 0.0007 | 0.18 | 14.3 | 0.014 | 0.43 | 0.005 | 0.03 |
| | 37 | 0.006 | 0.11 | 0.12 | 0.028 | 0.0005 | 0.18 | 14.3 | 0.014 | 0.43 | 0.005 | 0.03 |

| | | Content of chemical components (mass %) | | | | | | | Evaluation of quality | | |
|---|---|---|---|---|---|---|---|---|---|---|---|
| | No. | B | Mo | Sn | Cu | V | W | Nb/C + N | Toughness | Stamping | Cor. res. |
| Inv. steel | 1 | 0.0004 | | | | | | 16.5 | Good | Good | Good |
| | 2 | 0.0008 | | | | | | 23.3 | Good | Good | Good |
| | 3 | 0.0003 | | | | | | 21.1 | Good | Good | Good |
| | 4 | 0.0004 | | | | | | 22.2 | Good | Good | Good |
| | 5 | 0.0004 | | | | | | 21.1 | Good | Good | Good |
| | 6 | 0.0006 | | | | | | 23.3 | Good | Good | Good |
| | 7 | 0.0004 | 0.5 | | | | | 21.1 | Good | Good | Good |
| | 8 | 0.0007 | 1.1 | | | | | 25.3 | Good | Good | Good |
| | 9 | 0.0004 | | 0.007 | | | | 18.1 | Good | Good | Good |
| | 10 | 0.0004 | | 0.08 | | | | 18.1 | Good | Good | Good |
| | 11 | 0.0004 | 0.6 | 0.04 | | | | 21.0 | Good | Good | Good |
| | 12 | 0.0004 | | | 0.1 | | | 17.3 | Good | Good | Good |
| | 13 | 0.0005 | | | | 0.15 | | 19.0 | Good | Good | Good |
| | 14 | 0.0004 | | | | | 0.5 | 27.1 | Good | Good | Good |
| | 15 | 0.0004 | 0.4 | 0.08 | 0.1 | 0.2 | | 21.1 | Good | Good | Good |
| | 16 | 0.0004 | 0.5 | 0.07 | 0.2 | | 0.5 | 20.6 | Good | Good | Good |
| | 17 | 0.0005 | 0.09 | 0.09 | | 0.1 | | 21.1 | Good | Good | Good |
| | 18 | 0.0005 | 0.8 | 0.02 | 0.2 | 0.1 | 0.1 | 21.1 | Good | Good | Good |
| Comp. steel | 19 | 0.0004 | | | | | | 16.6 | Poor | Poor | Poor |
| | 20 | 0.0004 | | | | | | 16.0 | Poor | Poor | Good |
| | 21 | 0.0006 | | | | | | 16.5 | Poor | Poor | Poor |
| | 22 | 0.0004 | | | | | | 20.5 | Poor | Poor | Poor |
| | 23 | 0.0004 | | | | | | 21.0 | Poor | Poor | Poor |
| | 24 | 0.0006 | | | | | | 22.5 | Poor | Poor | Good |
| | 25 | 0.0004 | | | | | | 20.5 | Good | Good | Poor |
| | 26 | 0.0004 | | | | | | 20.5 | Poor | Poor | Good |
| | 27 | 0.0007 | | | | | | 13.5 | Poor | Poor | Good |
| | 28 | 0.0004 | | | | | | 10.0 | Good | Good | Poor |
| | 29 | 0.0004 | | | | | | 35.0 | Poor | Poor | Good |
| | 30 | 0.0004 | | | | | | 21.0 | Poor | Poor | Good |
| | 31 | 0.0004 | | | | | | 28.0 | Poor | Poor | Poor |
| | 32 | 0.0030 | | | | | | 21.5 | Poor | Poor | Good |
| | 33 | 0.0004 | 1.8 | | | | | 30.7 | Poor | Poor | Good |
| | 34 | 0.0004 | | 0.2 | | | | 21.5 | Poor | Poor | Good |
| | 35 | 0.0004 | | | 1.7 | | | 20.5 | Poor | Poor | Good |
| | 36 | 0.0004 | | | | 1.1 | | 21.5 | Poor | Poor | Poor |
| | 37 | 0.0004 | | | | | 1.1 | 21.5 | Poor | Poor | Poor |

As clear from Table 1, the hot rolled annealed sheet of steel of the chemical composition of the present invention is excellent in toughness and exhibits good stampability. Further, the corrosion resistance is also excellent. On the other hand, in the comparative steels outside the present invention, all of the Charpy impact value (absorption energy), stampability, and corrosion resistance were failing values. Due to this, it was learned that the ferritic stainless steel in the comparative examples was inferior in toughness and corrosion resistance.

Example 2

In this example, cases of changing the thickness and manufacturing conditions are shown. Steel No. 3, No. 8, and No. 9 in Table 1 were selected. Steels of their chemical compositions were smelted and cast into slabs. The slabs were heated to 1150 to 1250° C., then were hot rolled while changing the finishing temperatures in the range of 850 to 950° C. and the thickness in the range of 5 to 9 mm to obtain hot rolled steel sheets. The hot rolled steel sheets were cooled by mist cooling down to 450° C., then taken up into coils. After this, the hot rolled coils were annealed and cooled down to ordinary temperature. The annealing temperature and cooling conditions at this time were changed.

The thus obtained hot rolled annealed sheets were evaluated in the same way as Example 1 by a Charpy impact test, stamping test, and salt spray test. The evaluation criteria were also the same.

The test conditions and results of evaluation are shown in Table 2.

As clear from Table 2, the hot rolled annealed sheet of the steel of the chemical composition to which the present invention was applied was excellent in toughness and exhibited good stampability. Further, the corrosion resistance was also good. In the comparative examples outside the present invention, the Charpy impact value (absorption energy) and stampability were of failing values. Due to this, it is learned that the ferritic stainless steels in the comparative examples are inferior in toughness.

TABLE 2

| | No. | Comp. | Thickness mm | Annealing temp. ° C. | Cooling speed ° C./sec | Toughness | Stamping | Corrosion resistance | Others |
|---|---|---|---|---|---|---|---|---|---|
| Inv. steel | 3A | No. 3 | 5.5 | 1030 | 7 | G | G | G | |
| Inv. steel | 3C | | 8.0 | 1030 | 8 | G | G | G | |
| Comp. steel | 3D | | 10.0 | 1050 | 10 | P | P | G | |
| Comp. steel | 3E | | 7.5 | 950 | 7 | G | G | G | Non-recrystal. |
| Comp. steel | 3F | | 8.0 | 1150 | 10 | P | P | G | |
| Comp. steel | 3G | | 7.0 | 1050 | 3 | P | P | G | |
| Inv. steel | 8A | No. 8 | 5.5 | 1070 | 10 | G | G | G | |
| Inv. steel | 8B | | 8.5 | 1070 | 10 | G | G | G | |
| Comp. steel | 3D | | 10.0 | 1050 | 10 | P | P | G | |
| Comp. steel | 3E | | 7.5 | 950 | 7 | G | G | G | Non-recrystal. |
| Comp. steel | 3F | | 8.0 | 1150 | 10 | P | P | G | |
| Comp. steel | 3G | | 6.0 | 1050 | 3 | P | P | G | |
| Inv. steel | 9A | No. 9 | 6.5 | 1030 | 10 | G | G | G | |
| Inv. steel | 9B | | 7.5 | 1050 | 8 | G | G | G | |
| Comp. steel | 9C | | 9.5 | 1070 | 10 | P | P | G | |
| Comp. steel | 9D | | 7.5 | 950 | 7 | G | G | G | Non-recrystal |
| Comp. steel | 9E | | 8.0 | 1150 | 10 | P | P | G | |
| Comp. steel | 9F | | 6.5 | 1050 | 3 | P | P | G | |

INDUSTRIAL APPLICABILITY

As clear from the above explanation, according to the stainless steel hot rolled sheet and steel strip of the present invention, the corrosion resistance is excellent, the toughness is excellent, and even if working at 0° C., there is resistance to cracking, so the material yield is good and stainless steel sheet which is excellent in part manufacturability can be produced. That is, by applying the material to which the present invention is applied to particularly exhaust system parts of automobiles and motorcycles, parts with long service lives can be manufactured at a low cost and therefore the contribution to society can be raised. That is, the present invention is extremely beneficial in industry.

The invention claimed is:

1. A hot rolled ferritic stainless steel sheet comprising, by mass %,

C: 0.015% or less,
Si: 0.01 to 0.4%,
Mn: 0.01 to 0.8%,
P: 0.04% or less,
S: 0.01% or less,
Cr: 14.0 to less than 18.0%,
Ni: 0.05 to 0.3%,
Nb: 0.35 to 0.6%,
Ti: 0.05% or less,
N: 0.020% or less,
Al: 0.10% or less,
B: 0.0002 to 0.0020%,
Sn: 0.005 to 0.1%, and
a balance of Fe and unavoidable impurities,
wherein the contents of Nb, C, and N satisfy $$Nb/(C+N) \geq 16,$$

a Charpy impact value at 0° C. of the steel sheet is 10 $J/cm^2$ or more, and
a thickness of the steel sheet is 5.5 to 9.0 mm.

2. The hot rolled ferritic stainless steel sheet according to claim 1, further comprising, by mass %, one or more of Mo: 1.5% or less, Cu: 0.05 to 1.5%, V: 1% or less, and W: 1% or less.

3. A ferritic stainless steel strip comprised of the hot rolled ferritic stainless steel sheet according to claim 2.

4. A ferritic stainless steel sheet for automobile flange use comprised of the hot rolled ferritic stainless steel sheet according to claim 2.

5. A method of production of the hot rolled ferritic stainless steel sheet according to claim 1, comprising melting, casting, hot rolling, annealing, and pickling, wherein an annealing temperature in the annealing process is 1000° C. to 1100° C., and a cooling speed from 800° C. to 400° C. in a subsequent cooling process is 5° C./sec or more.

6. A ferritic stainless steel strip comprised of the hot rolled ferritic stainless steel sheet according to claim 1.

7. A ferritic stainless steel sheet for automobile flange use comprised of the ferritic stainless steel strip according to claim 6.

8. A ferritic stainless steel sheet for automobile flange use comprised of the hot rolled ferritic stainless steel sheet according to claim 1.

9. A method of production of the hot rolled ferritic stainless steel sheet according to claim 2, comprising melting, casting, hot rolling, annealing, and pickling, wherein an annealing temperature in the annealing process is 1000° C. to 1100° C., and a cooling speed from 800° C. to 400° C. in a subsequent cooling process is 5° C./sec or more.

* * * * *